US005634735A

United States Patent [19]

Horton et al.

[11] Patent Number: 5,634,735

[45] Date of Patent: Jun. 3, 1997

[54] TOOL COUPLER

[75] Inventors: Lee A. Horton, Jefferson; Arthur A. Erickson, Hubbardston, both of Mass.

[73] Assignee: Wain-Roy, Inc., Hubbardston, Mass.

[21] Appl. No.: 537,978

[22] Filed: Oct. 2, 1995

Related U.S. Application Data

[63] Continuation-in-part of Ser. No. 487,082, Jun. 7, 1995, abandoned.

[51] Int. Cl.[6] ..... E02F 3/96; E02F 9/00

[52] U.S. Cl. ..... 403/322; 403/321; 414/723

[58] Field of Search ..... 403/319, 321, 403/322, 325; 414/723; 172/272, 273; 37/468

[56] References Cited

U.S. PATENT DOCUMENTS

| | | | |
|---|---|---|---|
| 2,963,183 | 12/1960 | Przybylski | 414/723 |
| 3,934,738 | 1/1976 | Arnold | 414/723 |
| 4,297,074 | 10/1981 | Ballinger | 414/723 |
| 4,311,428 | 1/1982 | Arnold | 414/723 |
| 4,881,867 | 11/1989 | Essex et al. | 403/322 X |
| 5,082,389 | 1/1992 | Balemi | 403/325 X |
| 5,125,788 | 6/1992 | Stenger | 414/723 |
| 5,332,353 | 7/1994 | Arnold | 414/723 |
| 5,333,695 | 8/1994 | Walter | 172/272 |
| 5,382,110 | 1/1995 | Perotto et al. | 403/322 |
| 5,423,625 | 6/1995 | Gebauer et al. | 403/322 |

FOREIGN PATENT DOCUMENTS

| | | | |
|---|---|---|---|
| 47127 | 3/1985 | Japan | 414/723 |
| WO85/04440 | 10/1985 | WIPO | 414/723 |
| WO91/18716 | 12/1991 | WIPO | 403/322 |

*Primary Examiner*—Anthony Knight
*Attorney, Agent, or Firm*—Blodgett & Blodgett, P.C.

[57] ABSTRACT

A coupling apparatus for releasably securing a tool to the linkage of a tractor such as a backhoe. The coupling apparatus includes a second coupling element which is fixed to the lower end of the linkage and a first coupling element which is fixed to the upper end of the tool. One of the coupling elements has a generally upwardly facing first engaging surface for engaging a downwardly facing first engaging surface of the other coupling element which provides the main coupling connection between the first and second coupling elements. Each of the first and second coupling elements has a second engaging surface which is spaced from the first engaging surface. When the first and second coupling elements are brought together in a coupling mode, the second engaging surfaces engage and provide a fulcrum about which the linkage pivots relative to the tool. The first coupling element has a locking element at the rear end of the first coupling element for engaging a complimentary locking element at the rear end of the second coupling element for receiving a connector to lock the first and second locking elements together when the coupling apparatus is in the coupling mode. The connector is effective, when connecting the first and second coupling elements together, to force the rear end of the linkage downwardly relative to the tool with a primary downward preloading force along a primary line of action through the connector for pivoting the linkage about the fulcrum and for forcing the upwardly facing first engaging surface of one of the coupling elements against the downwardly facing first engaging surface of the other coupling element. The locking elements allow an upward or downward force to transmit to the rear to the tool.

28 Claims, 6 Drawing Sheets

FIG. 7

TOOL COUPLER

This application is a continuation-in-part of application Ser. No. 08/487,082, filed Jun. 7, 1995, now abandoned.

BACKGROUND OF THE INVENTION

The present invention is generally directed to coupling apparatus for releasably securing a tractor linkage to a tool such as: bucket, blade, ripper, auger, etc.

The task of connecting and disconnecting a tool on the linkage of a tractor such as a backhoe, excavator, loader, etc. has been simplified a great deal by the development of releasable quick change connectors. The connector includes a second coupling element on the tractor linkage and a first coupling element which is complementary with the second coupling element on each tool which is to be connected to the tractor linkage. A typical connecting system includes a cylindrical cross member at the front end of the tool and a pair of spaced hooks at the front end of the tractor linkage for engaging the cross member. When the tractor linkage is positioned in a coupling mode on the tool, the tool is secured to the tractor linkage by means of complementary locking means at the rear end of the tractor linkage and the tool. This type of coupler system permits a wide range of tools to be connected to any type of tractor or equivalent machine. The coupler system permits a single operator to change tools, in some cases, without leaving the operator's compartment.

One of the problems with the prior art tool coupling devices is that the interengaging elements of the tractor linkage and the tool wear, due to the high operating forces and extensive use of the equipment. As these interengaging parts begin to wear, the connections between the tractor linkage and the tool become loose. This adversely affects the operation of the tractor and, eventually, leads to downtime for the tractor and tools in order to repair or replace worn parts. These and other difficulties experienced with the prior art devices have been obviated by the present invention.

It is, therefore, a principal object of the present invention to provide a coupling apparatus for a tractor linkage which enables the tractor linkage to be coupled to a tool, easily and accurately.

Another object of the invention is the provision of a coupling apparatus for a tractor linkage which enables the tractor linkage to be coupled to a tool with a precise snug fit and to maintain the snug fit throughout the operation of the tool.

A further object of the present invention is the provision of a coupling apparatus for a tractor linkage which minimizes wear of the engaging portions of the coupling. It is another object of the present invention to provide a coupling apparatus for a tractor linkage which includes adjusting means for compensating for wear of the surfaces of the tractor linkage which engage complementary surfaces of the tool to avoid replacement of worn components and down time of tractor linkage and tool.

A still further object of the invention is the provision of a coupling apparatus for a tractor linkage which provides the superior coupling characteristics recited above for a tractor linkage which also includes a swinging capability. With these and other objects in view, as will be apparent to those skilled in the art, the invention resides in the combination of parts set forth in the specification and covered by the claims appended hereto.

SUMMARY OF THE INVENTION.

In general the invention consists of a coupling apparatus for releasably securing a tool to the linkage of a tractor such as a backhoe, excavator, loader, etc. The coupling apparatus includes a second coupling element which is fixed to the lower end of the dipper stick of a tractor linkage and a first coupling element which is fixed to the upper end of the tool. One of the coupling elements has a generally upwardly facing third engaging surface for engaging a downwardly facing first engaging surface of the other coupling element. This provides the main coupling connection between the first and second coupling elements. One of the coupling elements has a second engaging surface which is spaced from the first engaging surface. The other coupling element has a fourth engaging surface. When the tractor linkage is coupled to the tool, a primary downward preloading force is imparted to the rear end of the tractor linkage relative to the tool along a primary line of action which is at a right angle to the generally horizontal top end of the tool. When the first and second coupling elements are brought together in a coupling mode, the second and fourth engaging surfaces engage and form a fulcrum between the tool and the tractor linkage. The primary downward preloading force creates a moment about the fulcrum which is formed by the second and fourth engaging surfaces for forcing the third engaging surface against the first engaging surface with a resultant upward acting force along a resultant line of action which is at an acute angle to the primary line of action to provide stability to the coupling apparatus during normal operation of the tool and to maintain the first engaging surface in contact with the third engaging surface. The first coupling element has a first locking element at the rear end of the first coupling element for engaging a complementary second locking element at the rear end of the second coupling element and for receiving a connector to lock the first and second locking elements together when the coupling apparatus is in the coupling mode. An upward reactive force is formed at the fulcrum in response to the primary downward preloading force along a resultant line of action which is at an acute angle to the primary line of action. The connector effective for transmitting a downward or upward working force from the tractor linkage to the rear end of the tube.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
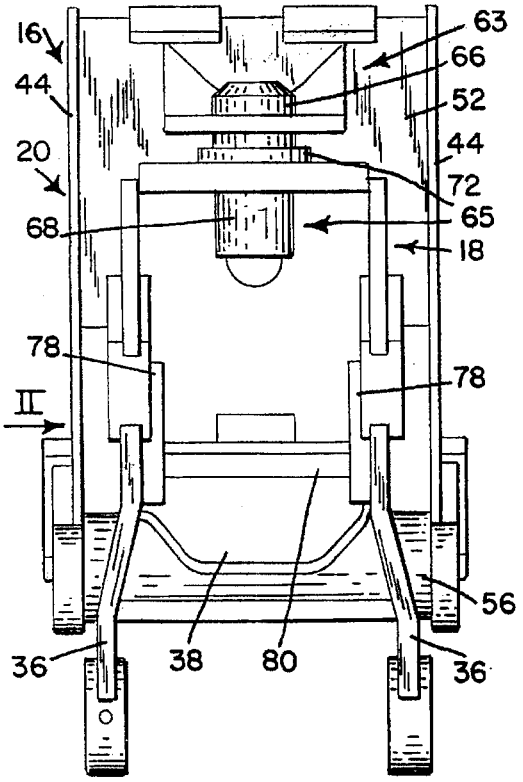
FIG. 1 is a top plan view of a coupling apparatus embodying the principals of the present invention.
Figure 3:
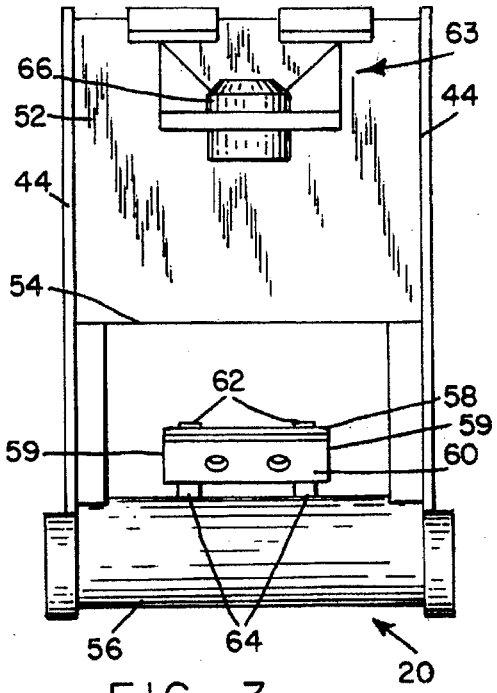
FIG. 3 is a top plan view of a portion of a coupling apparatus which is fixed to a materials handling tool.
Figure 2:
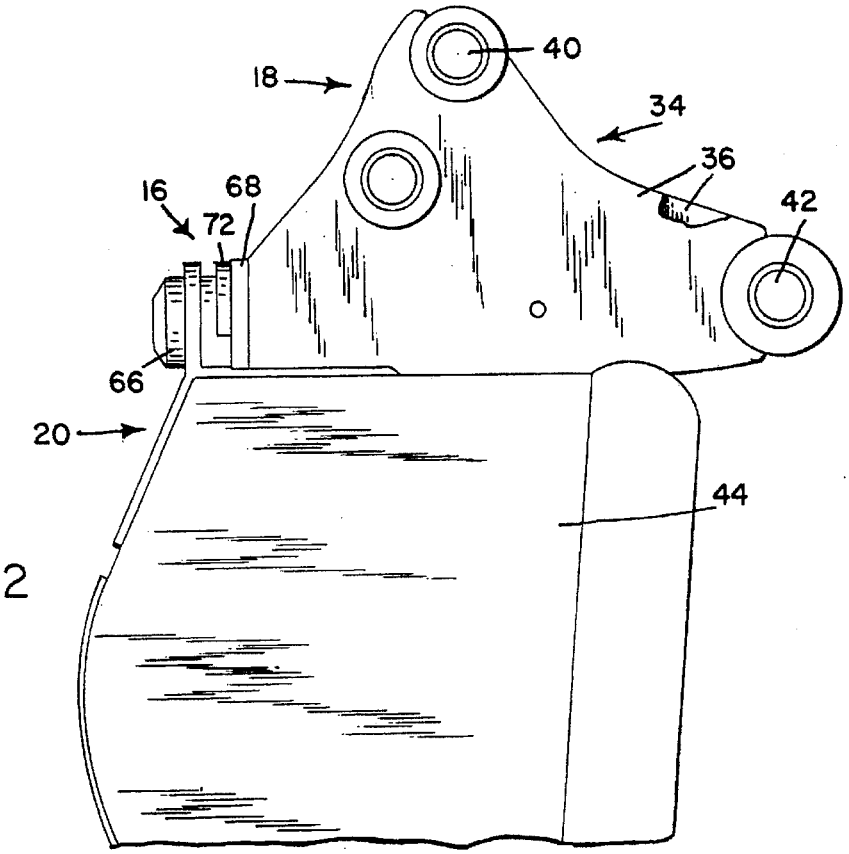
FIG. 2 is a side elevational view of the coupling apparatus, looking in the direction of arrow II of FIG. 1.

Referring first to FIGS. 1–4, the coupling apparatus of the present invention is generally indicated by the reference numeral 16 for coupling a tractor linkage which is generally indicated by the reference numeral 18 to a tool which, by way of example, is a bucket, generally indicated by the reference numeral 20.

Referring particularly to FIGS. 1–8, the tractor linkage 18 includes dipper stick or arm 22 which is pivotally connected to a main body, generally indicated by the reference numeral 34, by a hinge pin 42. A bucket link 24 is also connected to the main body 34 by a hinge pin 40. A guide link 26 is connected to the dipper stick 22 at one end by a hinge pin 32 and at its other end to the upper end of the guide link 24 by a hinge pin 28 which is also connected to a piston 30. The tractor linkage 18 is described in U.S. Pat. No. 3,934,738 which is incorporated herein by reference. Further details of the connection and the operation of the tractor linkage can be found in this patent. The main body 34 includes a pair of spaced vertical plates 36 which are connected, in part, by a cross plate 38. The tractor linkage 18 is adapted to exert a downward working force on the upper rearward portion of the bucket 20 for actuating the bucket 20 when the tractor linkage is in a coupling mode relative to the bucket 20.

Figures 4, 5, 6:
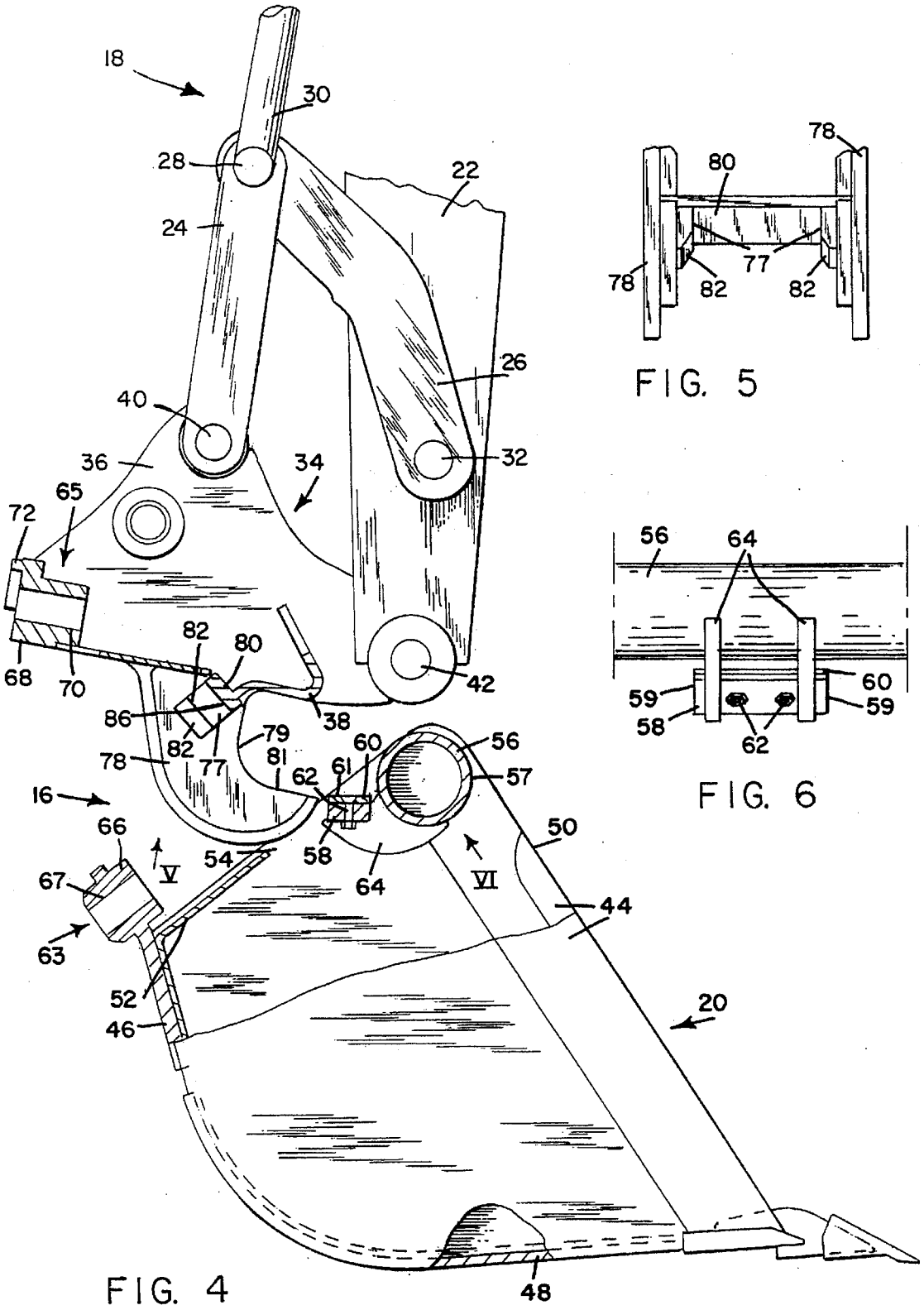
FIG. 4 is a side elevational view of a coupling apparatus with the coupling elements separated in a non-coupling mode and, with portions in section.
FIG. 5 is a fragmentary view of one of the coupling elements, looking in the direction of arrow V of FIG. 4.
FIG. 6 is a fragmentary view of the other of the coupling elements, looking in the direction of arrow VI of FIG. 4.
Figure 7:
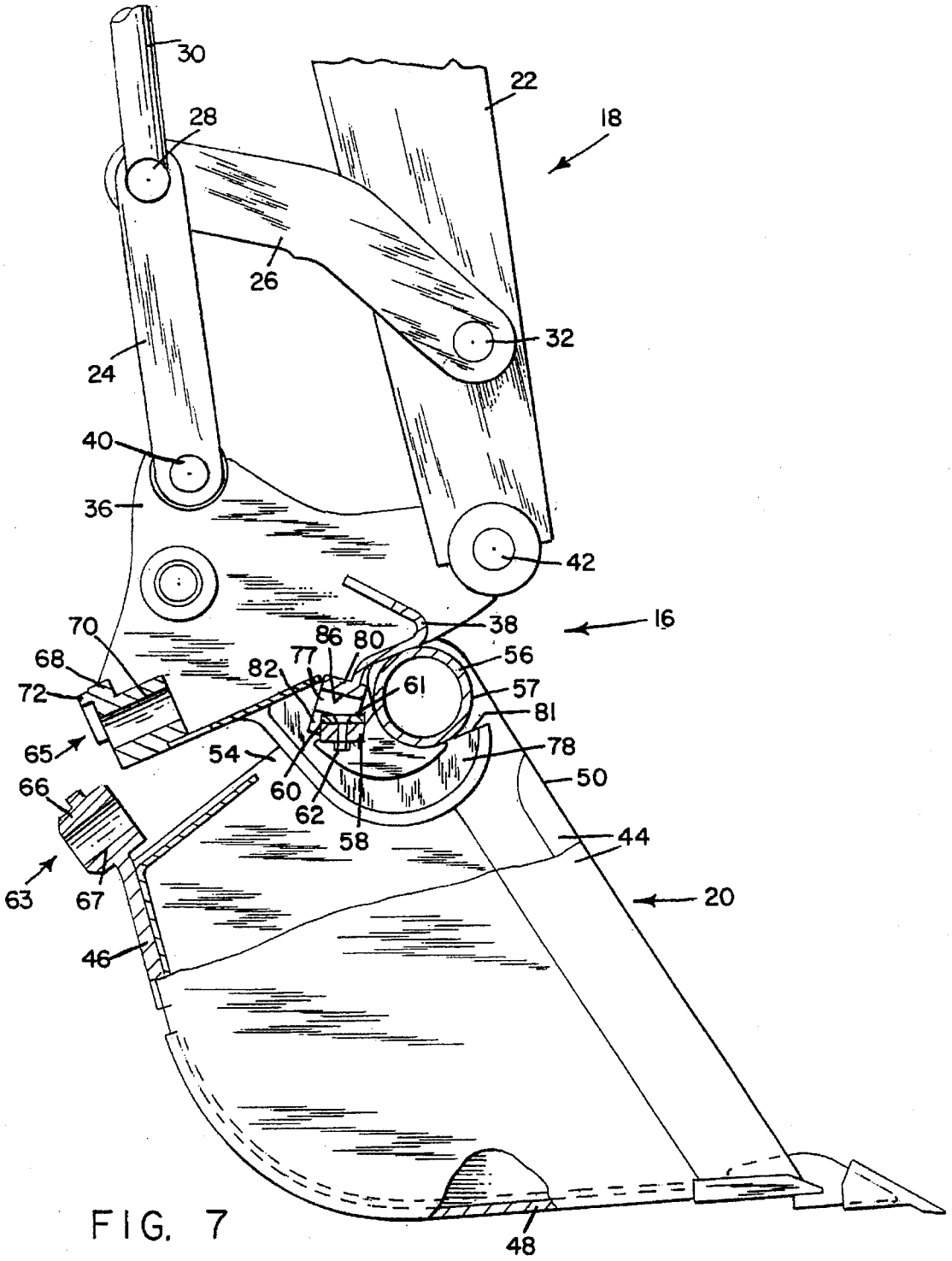
FIG. 7 is a view similar to FIG. 4, showing the coupling elements in transition between the uncoupling mode and the coupling mode.
Figure 8:
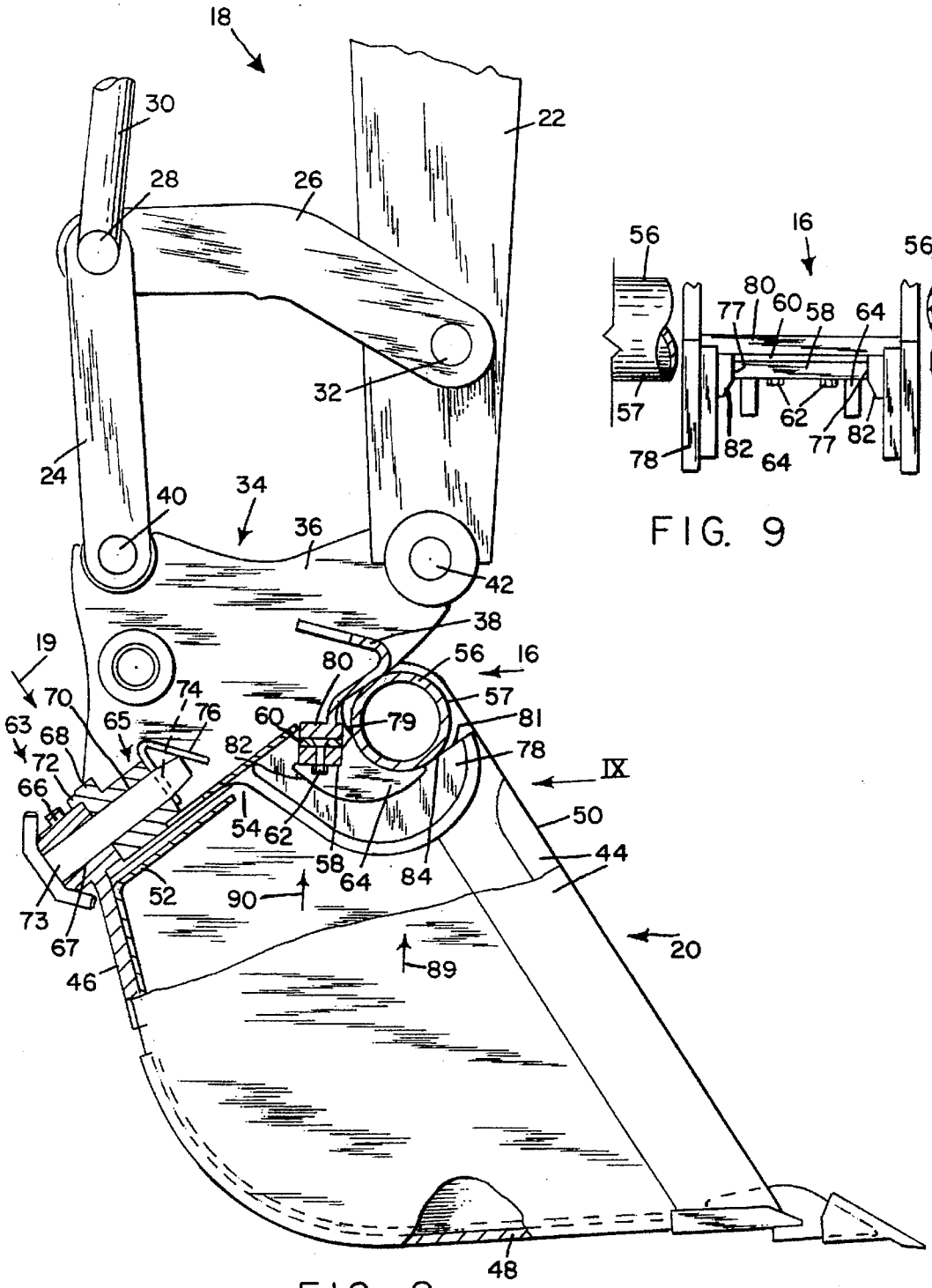
FIG. 8 is a view similar to FIGS. 4 and 7, showing the coupling elements in the coupling mode.

The bucket 20 has a pair of vertical side walls 44, a back wall 46, a bottom wall 48 and a front opening 50. The bucket 20 has top horizontal plate 52 which has a top opening 54. A cross tube 56 extends between the side plates 44 and has an outer cylindrical first engaging surface 57. A horizontal bar 58 is fixed to a pair of spaced vertical brackets 64 which are, in turn, fixed to the rear end of the cross tube 56. A shim plate 60 is removably connected to the bar 58 by a pair of fasteners 62. The bar 58 has end surfaces 59. The shim plate 60 has an upwardly facing second engaging surface 61 which is spaced from the first engaging surface and is at an acute angle to the primary line of action 19 of the tractor linkage 18 when the tractor linkage is in its coupling mode with the tool 20. The bucket 20 is shown in FIGS. 4, 7 and 8 in its normal resting position on the ground prior to being coupled with the tractor linkage 18, wherein the generally horizontal upper periphery of the bucket is at an angle to the horizontal. However, during operation of the tractor, the upper end of the bucket is generally horizontal.

The bucket 20 has a cylindrical bearing 66 which extends upwardly from the rear end of the bucket. The bearing 66 has a horizontal cylindrical bore 67. The main body 34 has a cylindrical bearing 68 at its rear end. The bearing 68 has a horizontal cylindrical bore 70 and a semi-circular projection or crescent 72 at the rearward end of the bearing 68. When the coupling apparatus of the present invention is moved from its uncoupling mode as shown in FIG. 4 to its coupling mode as shown in FIG. 8 the rearward end of the cylindrical beating 68 and 66 abut so that the horizontal bores 67 and 70 are aligned and the crescent 72 engages the upper cylindrical surface of the bearing 66 at the forward end of the bearing 66. This helps to position correctly the beating 68 relative to the bearing 66. The cylindrical bearings 66 and 68 constitute complementary first and second locking elements 63 and 65, respectively, which are locked together by a connector pin 73 the connector pin 73 is inserted into the bores 67 and 70 so that the forward end of the pin extends forwardly of the bearing 68 as shown in FIG. 8. The forward end of the pin 73 has a transverse bore 74 for receiving a latch pin 76 to secure the connector pin 73 in its locking position. The central longitudinal axis of the bore 70 is slightly higher than the central longitudinal axis of the bore 67. When the pin 73 is inserted into the bores 70 and 67, the rear end of the tractor linkage is forced downwardly relative to the tool 20 with a primary downward preloading force along a primary line of action 19 through the pin 73. The forward end of the pin 67 is beveled to enable the pin to be inserted into the misaligned bores 67 and 70. The preloading force is substantially less than the working force for operating the tool or bucket 20

The main body 34 has a pair of downwardly extending spaced vertical hooks 78. Each hook 78 has an upwardly and forwardly facing surface 79. Each surface 79 is concave and has a radius of curvative which is substantially equal to the radius of the cylindrical surface 57. Surfaces 79 collectively form a third engaging surface. A cross bar 80 extends horizontally between the hooks 78 and is fixed to the cross plate 38. Each hook 78 has an inwardly facing surface 77 and a downwardly and inwardly facing surface 82 and is shown most clearly in FIGS. 4 and 5. The bar 80 has a downwardly facing fourth engaging surface 86 which is at an angle to the primary line of action 19 of the tractor linkage when the main body 34 is coupled to the bucket 20, as shown in FIG. 8. When the coupling apparatus 16 of the present invention is in its coupling mode, as shown in FIG. 8, the fourth engaging surface 86 of the bar 80 engages the second engaging surface 61 of the shim plate 60.

When the tractor linkage 18 is moved from its uncoupled position relative to the bucket 20, as shown in FIG. 4, to its coupled position, as shown in FIG. 8, the hooks 78 are inserted through the opening 54 so that the hooks pass rearwardly of the bar 58 and are positioned below the tube 56, as shown in FIG. 7. Also, in this position, the downwardly facing fourth engaging surface 86 of the bar 80 is located above the upwardly facing second engaging surface 61 of the shim plate 60. As the main body 36 continues to move towards the coupling position as shown in FIG. 8, the fourth engaging surface 86 engages the second engaging surface 61. The engagement of the second and fourth engaging surfaces 61 and 86, respectively, forms a fulcrum between the tool 20 and the tractor linkage 18. There is sufficient elasticity in the coupling apparatus so that when the pin 73 is forced into the misaligned bores 67 and 70, the bores 67 and 70 become aligned. The primary downward preloading force along the primary line of action 19 produces a moment about the fulcrum which is formed by the engaging surfaces 86 and 61. This causes the third engaging surface 79 of the hooks 78 to be forced against the first engaging surface 57 of the tube 56 with a resultant upward acting force along a resultant line of action 89. This insures that the surfaces 57 and 29 remain in tight engagement throughout the operation of the tool. The resultant line of action 89 is at an acute angle to the primary line of action 19. The preferred angle of the resultant line of action relative to the primary line of action 19 is from 15° to 75°. The primary downward preloading force and the resultant upward acting force are opposed by an upward reactive force at the fulcrum along a reactive line of action, indicated by arrow 90 in FIG. 8. The reactive line of action 90 is parallel to the resultant line of action 89 and transverse to the surfaces 61 and 82. This maintains the surface 79 in tight engagement with the surface 57 during operation of the tractor in all of its phases of operation. This close engagement between the surfaces 57 and 79 prevents foreign material such as dirt from entering between the engaging portions of the surfaces 57 and 79 and significantly reduces the amount of wear on these engaging portions.

Figure 9:
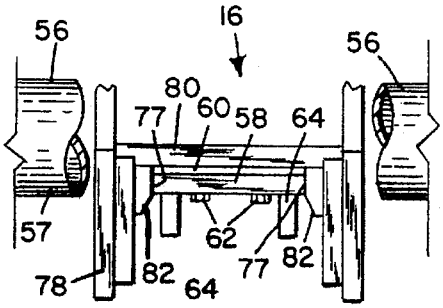
FIG. 9 is a fragmentary view of the coupling elements, looking in the direction of arrow IX of FIG. 8.

As the hooks 78 are moved toward their final position, as shown in FIG. 8, the end surfaces 59 of the bar 58 engage the inwardly facing surfaces 77 of the hooks 78 to provide lateral stability to the coupling of the tractor 18 and the tool 20 when the coupling apparatus 16 is in its final coupling position as shown in FIGS. 8 and 9. The end surfaces 59 are guided into engagement with the surfaces 77 by the cam surfaces 82. The surface 79 of each hook 78 is concave and has the same radius as the surface 57 of the cross tube 56 for snugly engaging the rear half of the cross tube 56 when the coupling apparatus 16 of the present invention is in the coupling position as shown in FIG. 8. The forward end of each hook 78 has a flat upwardly facing edge surface 81 for engaging the corresponding flat upwardly facing surface which is found on many tools which are still in existence. This enables the tractor linkage 18 which is provided with the coupling apparatus of the present invention to be used with tools 20 which are provided with the coupling apparatus of the present invention as well as with certain prior art tools which are still in existence. In the example shown in the drawings, the surfaces 79 of the hooks 78 and the surface 86 of the cross bar 80 constitute a second coupling element. The outer cylindrical surface 57 of the cross tube 56 and the surface 61 of the shim plate 60 and the first locking element 65 constitute a first coupling element, the apparatus which is shown and described constitutes a preferred embodiment of the invention. However, other variations of the first and second coupling elements are possible. For example, the hooks 78 and bar 80 can be part of the bucket 20 and the tube 56 along with the bar 58 and the shim plate 60 can be part of the main body 34.

During operation of a tractor which is provided with the coupling apparatus of the present invention, the lifting force between the main body 34 and the bucket 20 is transmitted to the upwardly facing portions of the hooks 78 and the downwardly facing portions of the cross tube 56. The pushing force is transmitted to the forwardly facing portions of the hooks 78 and the rearwardly facing portion of the cross tube 56. The downward working force from the tractor linkage 18 is transmitted to the tool 20 through the pin 73.

Wear between the engaging surface portions of the tractor coupling and the bucket is greatly reduced by the coupling of the present invention. However, over a period of time, wear does occur to one or more of the engaging surfaces. Eventually the initial "preloading" of the coupling is lost and the coupling becomes loose at the points of engagement between the tractor linkage and the bucket. This enables foreign material to enter between the surfaces 57 and 79 and between the surfaces 60 and 86, which causes additional wear to occur at the engaging surfaces. When the coupling apparatus 16 loosens because of wear, the shim plate is removed from the bar 58 by removing the fasteners 62. One or more of the shims are applied to the horizontal bar 58 and the shim plate 60 is reapplied to the bar 58. This raises the surface 60 so that when the tractor linkage 18 is applied to the bucket 20, the coupling 16 is returned to its "preloaded" state. If desired, the shim plate 60 can also be replaced by a thicker shim plate to achieve the same results.

In the preferred embodiment of the present invention, the bar 80 is substantially harder than the shim plate 60 so that any wear which results from the engagement of the surfaces 86 and 61 is more likely to be to the shim plate 60.

Figure 10:
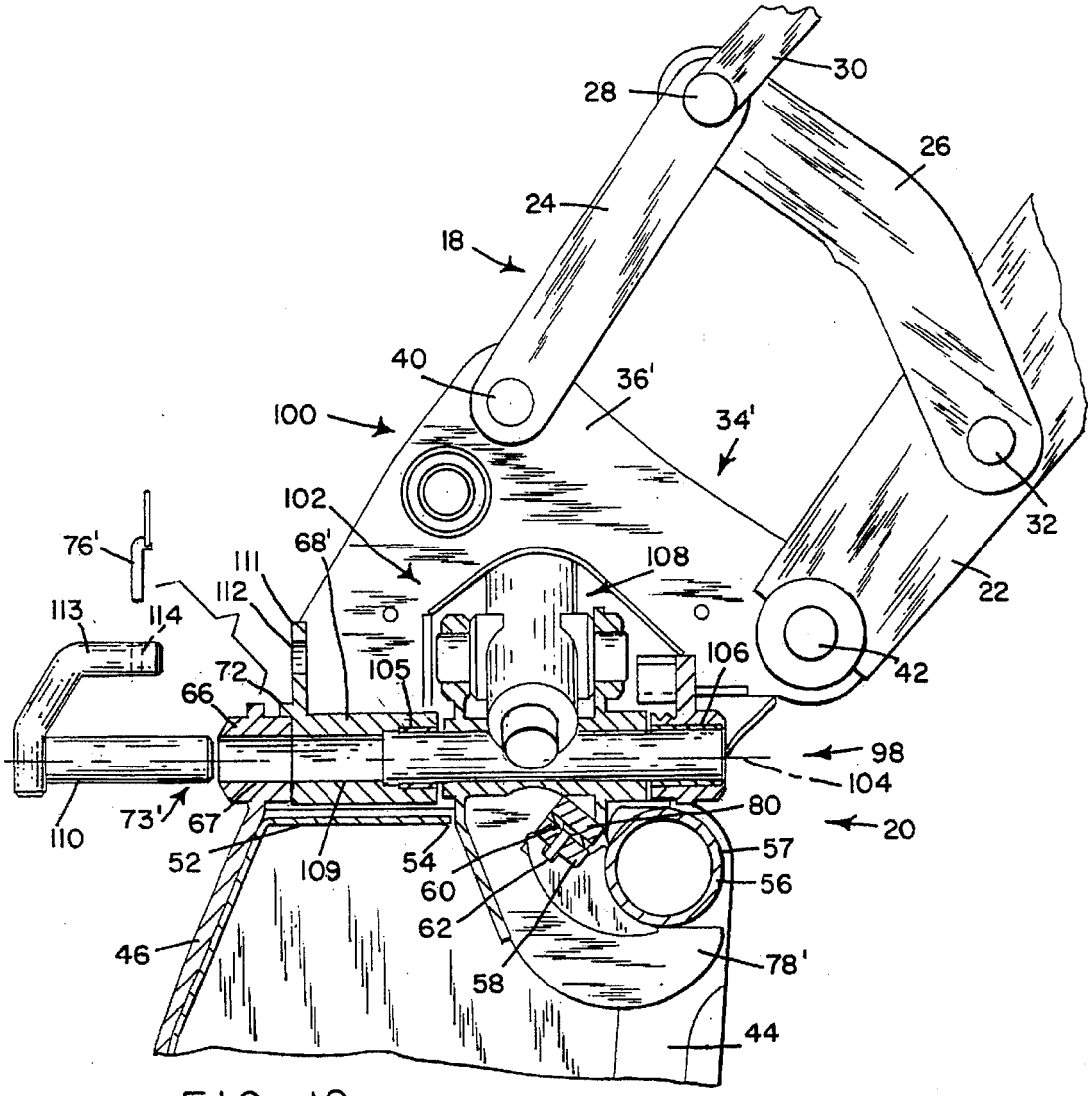
FIG. 10 is a fragmentary side elevational view of the coupling apparatus of the present invention which is similar to FIG. 8 and shows a modified tractor linkage which is provided with a swinging mechanism.

Referring to FIG. 10, there is shown a modified coupling apparatus, generally indicated by the reference numeral 98, which is applied to the bucket 20 and a modified tractor linkage which is generally indicated by the reference numeral 100. The tractor linkage 100 is identical to the tractor linkage 18 and has a main body portion which is generally indicated by the reference numeral 34'. The main body portion 34' is similar to the main body portion 34 except that it includes a tool tilting apparatus which is generally indicated by the reference numeral 102. The swinger apparatus 102 is a standard apparatus which enables the materials handling tool and a coupling apparatus 98 to swing relative to the vertical plates 36' of the main body 34' about a front to back horizontal axis 104. The hooks 78' of the hitch 100 are fixed to a swinger housing 105 which is pivotally mounted in forward and rearward bearings 106 and 68', respectively, for swinging about the horizontal axis 104. The swinging motion is controlled by a hydraulic actuator which is generally indicated by the reference numeral 108 which is operatively connected to the hydraulics of the tractor. The rearward portion of the bearing 68' is similar to the bearing 68 and cooperates with the bearing 66 of the bucket 20 in the same manner as the bearings 68. The bearing 68' has a horizontal cylindrical bore 109 which is horizontally aligned with the bore 67 of the bearing 66 for receiving a first cylindrical portion 110 of a connector pin 73'. The bearing 68' has an upwardly extending flange 111 which has an aperture 112 for receiving a second cylindrical projection 113 of the connecting pins 73'. The projection 113 has a transverse bore 114 for receiving a latch pin 76' after the projection has been inserted through the aperture 112.

Figure 11:
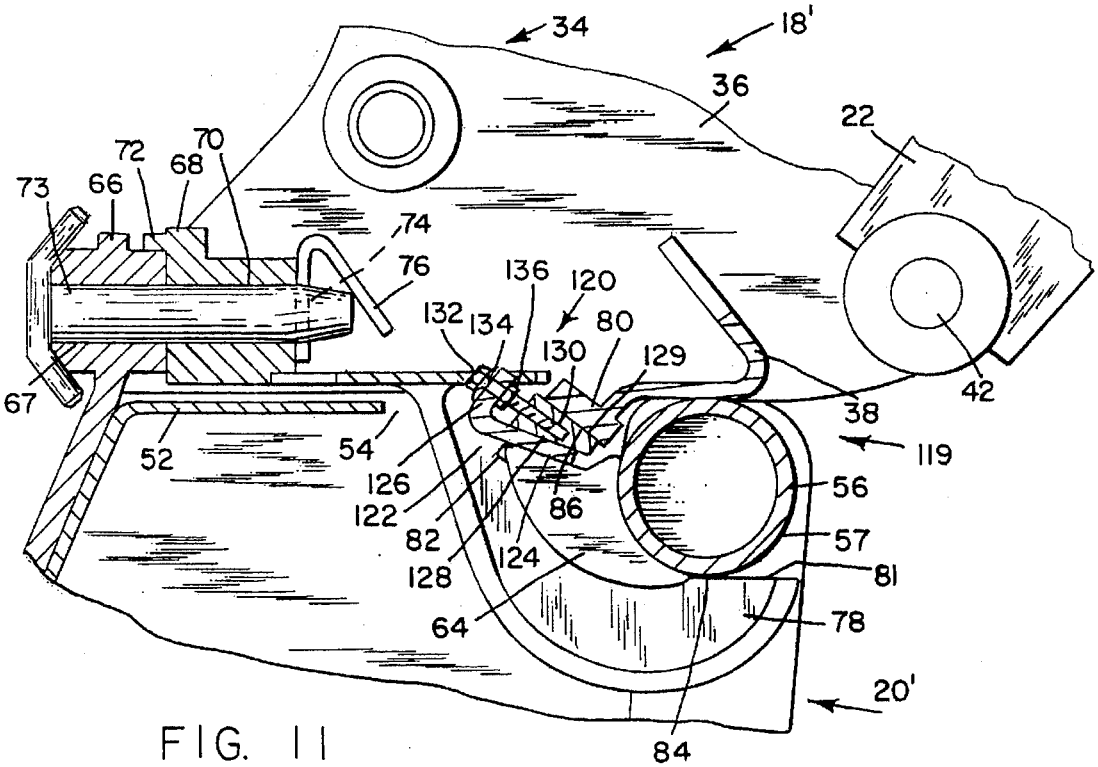
FIG. 11 is a fragmentary side elevational view of a first modified coupling which includes tensioning and wear compensating means.

Referring to FIG. 11, there is shown a first modified coupling apparatus which is generally indicated by the reference numeral 119 and which forms part of a first modified tractor linkage 18' and a first modified tool or bucket 20'. The first modified coupling apparatus 119 is identical to the coupling apparatus 16 with respect to the locking elements, the hooks 78, and the tube 56. The first modified coupling apparatus 119 differs from the coupling apparatus 16 in the area where a fulcrum is formed between the tractor linkage 18 and the bucket 20. The first modified coupling apparatus 119 includes at the fulcrum adjusting means, generally indicated by the reference numeral 120. The adjusting means 120 includes the cross bar 80 which is fixed to the cross plate 38, an L-shaped bar, generally indicated by the reference numeral 122, and a tapered wedge block 128. The L-shaped bar 122 includes a forward leg portion 124 which is fixed to the top edges of the brackets 64 and a rear upwardly extending leg portion 126. A screw 132 extends freely through the leg portion 126 and is threaded into a bore 130 in the wedge block 128. A spring washer 134 is located on the rear side of the leg portion 126 and the head of the screw 132. A lock nut 136 is threaded onto the screw 132 at the forward side of the leg portion 126. The wedge block 128 has an upper surface 129 which bears against the lower surface 86 of the cross bar 80. The wedge block 128 is moved forwardly and rearwardly relative to the L-shaped bar 122 by turning the screw 132. The rearward and forward movement of the wedge block 128 causes the surface 129 to move rearwardly and forwardly from the lower surface 86 of the cross bar 80 when the tractor linkage 18' is in its coupling mode relative to the tool 20', as shown in FIG. 11. When the first modified coupling apparatus 119 is initially installed, the wedge block 128 is positioned so that when the tractor linkage 18' is in the coupling mode relative to the tool 20' the surface 129 of the wedge block bears against the lower surface 86 of the cross bar 80 with sufficient pressure to create a "preloading" condition which forces the third engaging surface 79 of the hooks 78 against the surface 57 of the tube 56. In the event of wear to any of the engaging surfaces, the wedge block 128 is adjusted forwardly. This is accomplished by loosening the lock nut 136 and turning the screw 132. As the screw 132 is backed out of the aperture 130, wedge block 128 is adjusted forwardly. The forward advance of the wedge block 128 causes the surface 129 to move toward the lower surface 86 and return the coupling apparatus 119 to its original "preloading" condition.

Figure 12:
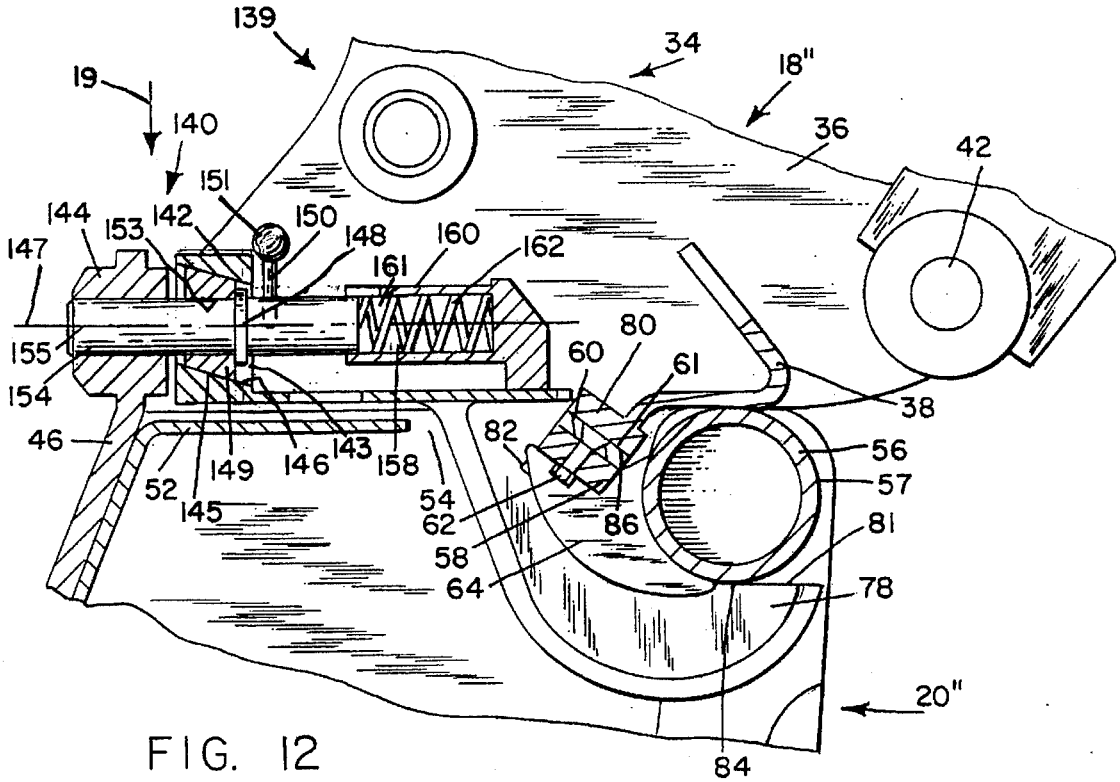
FIG. 12 is a fragmentary side elevational view of a second modified coupling which includes tensioning and wear compensating means.

Referring to FIG. 12, there is shown a second modified coupling apparatus, generally indicated by the reference numeral 139 and which forms part of a second modified tractor linkage 18" and a second modified tool or bucket 20". The second modified coupling apparatus 139 is identical to the coupling apparatus 16 except for the locking means at the rear end of the tool 20" and tractor linkage 18" The locking means for the second modified coupling apparatus 139 includes tensioning and wear compensating means which is generally indicated by the reference numeral 140.

The tensioning and wear compensating means 140 comprises a first protrusion 142 which is fixed to the rear end of the tractor linkage 18" and a second protrusion 144 which is fixed to the rear portion of the tool 20". The second protrusion 144 has a cylindrical bore 154 which extends along a horizontal axis 147. The axis 147 is transverse to the primary line of action 19. The first protrusion 142 has a bore 143 which is at an acute angle to the axis 147 when the tractor linkage 18" is in the coupling mode with the tool or bucket 20" as shown in FIG. 12. The lower end of the bore 143 has an upwardly facing surface 146 which is at an acute angle to the axis 147. A cam block 149 is slidably mounted within in the bore 143 and has the shape of a parallelogram in cross section as shown in FIG. 12. The cross-sectional shape of the cam block 149 matches the cross-sectional shape of the bore 143. The cam block 149 has a downwardly facing surface 145 which engages the upwardly facing surface 146 of the first protrusion 142. The cam block 149 has a central horizontal bore which is co-axial with the axis 147 and which is axially aligned with the bore 154 when the tractor linkage 18" is in coupling engagement with the tool 20". A cylindrical connector pin 155 is slidably mounted within the bore 153 along the horizontal axis 147. The forward end of the pin 155 is slidably mounted within the cylindrical bore 161 of a housing 160 which is fixed to the upper end of the tractor linkage 18". A spring 162 is located within the bore 161 for biasing the pin 155 rearwardly toward the bore 154. A collar 148 is fixed to the pin 155 for engaging block 149 when the tractor linkage 18" is in the coupling mode with the tool 20" and the pin 155 is in the lock position as shown in FIG. 12. A retracting pin 150 is fixed to the pin 155. The upper end of the retracting pin 150 has a finger knob 151 which enables an operator to retract the pin 155 from its locked position against the bias of the spring 162 to an unlocked position wherein the rearward end of the pin 155 is clear of the bore 154.

When the tractor linkage 18" is brought into coupling engagement with the tool 20", the pin 155 is maintained in its unlocked or retracted position and then released so that the pin 155 slides freely through the bore 153 and into the bore 154. The collar 148 engages the cam block 149 and urges the block 149 rearwardly under the bias of the spring 162. This causes the downwardly facing surface 145 of the block 149 to forcefully engage the upwardly facing surface 146 of the first protrusion 142. Since the surfaces 145 and 146 are at an acute angle relative to the horizontal axis 147, the rearward movement of the surface 145 along the surface 146 causes the first protrusion 142 to move downwardly relative to the second protrusion 144. This creates a primary downward preloading force which causes the tractor linkage 18" to pivot about the fulcrum which is formed between the bar 80 and the shim plate 60 and causes the forwarding facing surfaces 79 of the hooks 78 (first engaging surface) to bear tightly against the rearwardly facing portions of the surface 57 of the cylindrical cross tube 56. This is equivalent to the "preloading" condition which was described in connection with the coupling apparatus 16 which is shown in FIGS. 1–9. The tensioning and wear compensating means 140 maintains the "preloading" condition after the first, second, third, and fourth engaging surfaces sustain wear during subsequent use of the tractor linkage 18" and the tool 20". As wear occurs in any of these engaging surfaces, the cam block 149 is moved rearwardly in an additional amount by the bias of the spring 162. This rearward movement of the block 149 causes the tractor linkage 18" to move downwardly relative to the tool or bucket 20" to compensate for wear and to maintain the "preloading" condition. The downward working force from the tractor linkage 18" is transmitted to the tool 20" through the pin 55.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters patent is:

1. Coupling apparatus for releasably securing a tool to a tractor linkage, each of said tractor linkage and said tool having a front end and a rear end, said tool having an upper end, said tractor linkage having a lower end, said tractor linkage being movable relative to said tool between a coupling mode and an uncoupling mode, said tractor linkage being adapted to exert a downward working force on the rear end of said tool for actuating said tool when said tractor linkage is in said coupling mode with said tool, said coupling apparatus comprising:

(a) a first coupling element which is fixed to the upper end of said tool, said first coupling element comprising:
  (1) a first engaging surface at the front end of the tool;
  (2) a first locking element at the rear end of said tool; and
  (2) a second engaging surface located between said first locking element and said first engaging surface;

(b) a second coupling element which is fixed to the lower end of said tractor linkage, said second coupling element comprising:
  (1) a third engaging surface at the front end of said tractor linkage for engaging said first engaging surface and for constituting a first contact area when said tractor linkage is in said coupling mode with said tool, one of said first and third engaging surfaces facing generally downwardly and rearwardly and the other of said first and third engaging surfaces facing generally upwardly and forwardly;
  (2) a second locking element at the rear end of said tractor linkage, said second coupling element being complementary to said first coupling element; and
  (3) A fourth engaging surface located between said second locking element and said third engaging surface for contacting said second engaging surface and for constituting a second contact area when said tractor linkage is in said coupling mode with said tool, one of said second and fourth engaging surfaces facing generally downwardly and rearwardly and the other of said second and fourth engaging surfaces facing generally upwardly and forwardly, one of said first and second contact areas constituting a fulcrum for maintaining said first coupling element in engagement with said second coupling element at the other of said first and second contact areas; and (c) a connector for locking said first and second locking elements together when said tractor linkage is in said coupling mode with said tool, said connector being effective to transmit a vertical downward or upward force from the tractor linkage to said tool at the rear end of the tool and an upward or downward vertical force from the tractor linkage to the tool at the other of said first and second contact areas.

2. Coupling apparatus as recited in claim 1, wherein each of said second and fourth engaging surfaces is substantially flat.

3. Coupling apparatus as recited in claim 1, wherein said coupling apparatus further comprises a plate which is removably connected to one of said first and second coupling elements; said plate having an outer surface which constitutes one of said second and fourth engaging surfaces.

4. Coupling apparatus as recited in claim 3, wherein said plate is relatively softer than the other of said second and fourth engaging surfaces.

5. Coupling apparatus as recited in claim 1, wherein said first locking element is a first protrusion, said second locking element is a second protrusion, and said connector is an elongated pin, said first protrusion having a first bore which has a longitudinal axis, said second protrusion having a second bore which has a longitudinal axis so that when said tractor linkage is in said coupling mode with said tool, said second protrusion is adjacent said first protrusion and the longitudinal axis of said second bore is sufficiently vertically misaligned with the longitudinal axis of said first bore for enabling said elongated pin to be inserted into said first and second bores and to force said first and second bores into axial alignment.

6. Coupling apparatus as recited in claim 1, wherein said first locking element is a first protrusion, said second locking element is a second protrusion, and said connector is an elongated pin, said first protrusion having a first bore which has a longitudinal axis, said second protrusion having a second bore which has a longitudinal axis so that when said tractor linkage is in said coupling mode with said tool, said second protrusion is adjacent said first protrusion and the longitudinal axis of said second bore is substantially axially aligned with the longitudinal axis of said first bore for enabling said elongated pin to be inserted into said first and second bores.

7. Coupling apparatus as recited in claim 1, wherein said first and second locking elements comprises tensioning and wear compensating means.

8. Coupling apparatus as recited in claim 7, wherein one of said first and second locking elements is a first protrusion, and the other of said first and second locking element is a second protrusion, and said connector is mounted on said first protrusion for movement along a substantially horizontal longitudinal axis from an unlocked position toward said second protrusion to a locked position, said tensioning and wear compensation means comprising:

(a) a first cam surface which is at an acute angle to said longitudinal axis on one of said first and second protrusions;

(b) a second cam surface which is operatively connected to said connector, said second cam surface being out of pressing engagement with said first cam surface when said connector is in said unlocked position, said second cam surface being in pressing engagement with said first cam surface when said connector is in said locked position.

9. Coupling apparatus as recited in claim 8, wherein said tensioning and wear compensating means further comprise biasing means for biasing said connector toward said second protrusion to maintain said second cam surface in pressing engagement with said first cam surface to compensate for wear on any one of said first, second, third and fourth engagement surfaces.

10. Coupling apparatus as recited in claim 1, further comprising:

(a) a pair of spaced outwardly facing vertical stabilizing surfaces on one of said first and second coupling elements;

(b) a pair of spaced inwardly facing vertical surfaces on the other of said first and second coupling elements for engaging said outwardly facing vertical stabilizing surfaces when said coupling apparatus is in said coupling mode for providing lateral stability to the coupling of said tool and said tractor linkage.

11. Coupling apparatus as recited in claim 10, wherein at least one of said tool and said tractor linkage has vertical cam surfaces for guiding the vertical stabilizing surfaces of the other of said tool and said tractor linkage into engagement with the vertical stabilizing surfaces of said one of said tool and said tractor linkage when said linkage is moved from said uncoupling mode to said coupling mode relative to said tool.

12. Coupling apparatus as recited in claim 1, wherein said first and third engaging surfaces form a first functional pair of engaging surfaces and said second and fourth engaging surfaces form a second functional pair of engaging surfaces, and wherein said coupling apparatus further comprises adjusting means for adjustably positioning one of the engaging surfaces of at least one of said first and second functional pairs of engaging surfaces toward and away from the other engaging surface of said one pair of engaging surfaces.

13. Coupling apparatus as recited in claim 12, wherein said adjusting means comprises:

(a) a fixed surface on one of said tool and said tractor linkage;

(b) a plate which contains said one engaging surface to be adjusted; and (c) fastening means for removably connecting said plate to said fixed surface to enable plates of different thicknesses to be used and to enable a single plate to be used in conjunction with the positioning of shims of different thicknesses to be positioned between the plate and said fixed surface.

14. Coupling apparatus as recited in claim 12, wherein said adjusting means comprises:

(a) a fixed structure on one of said tool and said tractor linkage;

(b) a movable structure which contains said one engaging surface to be adjusted and which is mounted on said fixed structure for movement relative to said fixed structure so that said one engaging surface is moved at a right angle to the other engaging surface of said one functional pair of engaging surfaces; and (c) an adjusting screw which is threaded into one of said fixed structure and said movable structure and operatively connected to the other of said fixed structure and to said movable structure so that said movable structure is moved relative to said fixed structure as said screw is rotated.

15. Coupling apparatus for releasably securing a tool to a tractor linkage, each of said tractor linkage and said tool having a front end and a rear end, said tool having an upper end, said tractor linkage having a lower end, said tractor linkage being movable relative to said tool between a coupling mode and an uncoupling mode, said tractor linkage being adapted to exert a downward working force on the rear end of said tool for actuating said tool when said tractor linkage is in said coupling mode with said tool, said coupling apparatus comprising:

(a) a first coupling element which is fixed to the upper end of said tool, said first coupling element comprising:
  (1) a first downwardly and rearwardly facing engaging surface at the front end of said tool;
  (2) a first locking element at the rear end of said tool; and
  (3) a second upwardly and forwardly facing engaging surface which is spaced from said first engaging surface;

(b) a second coupling element which is fixed to the lower end of said tractor linkage, said second coupling element comprising:
  (1) a third upwardly and forwardly facing engaging surface at the front end of said tractor linkage for engaging said first engaging surface when said tractor linkage is in said coupling mode with said tool,
  (2) a second locking element at the rear end of said second coupling element, said second coupling element being complementary to said first coupling element; and
  (3) A fourth downwardly and rearwardly facing engaging surface which is spaced from said third engaging surface for contacting said second engaging surface when said linkage is in said coupling mode with said tool for forming a fulcrum between said third engaging surface tool and said second locking element for maintaining said third engaging surface in contact with said first engaging surface;

(c) a connector for locking said first and second locking elements together when said tractor linkage is in said coupling mode with said tool, said connector being effective to transmit a vertical downward or upward force from the tractor linkage to said tool at the rear end of the tool and an upward or downward vertical force from the tractor linkage to the tool at the front end of the tool through the engagement of said first and third engaging surfaces.

16. Coupling apparatus as recited in claim 15, wherein said first engaging surface is curved and convex and said third engaging surface is curved and concave.

17. Coupling apparatus as recited in claim 16, wherein said tool has a first side and a second side which is spaced from said first side, each of said first and second sides extending from the front end of said tool to the rear end of said tool, and wherein said first engaging surface is a horizontal cylindrical surface which extends from said first side to said second side.

18. Coupling apparatus as recited in claim 17, further comprising a pair of spaced hooks, a portion of each of said hooks constituting said third engaging surface.

19. Coupling apparatus as recited in claim 18, wherein said fourth engaging surface extends laterally between said hooks.

20. Coupling apparatus as recited in claim 18, wherein each of said hooks has an inwardly facing vertical stabilizing surface and said tool has a pair of outwardly facing vertical stabilizing surfaces for engaging the inwardly facing vertical stabilizing surface of each of said hooks for providing lateral stability to the coupling of said tool and said linkage.

21. Coupling apparatus as recited in claim 20, wherein at least one of said tool and said hooks has vertical cam surfaces for guiding said outwardly facing vertical stabilizing surfaces into engagement with said inwardly facing vertical stabilizing surfaces when said linkage is moved from said uncoupling mode to said coupling mode relative to said tool.

22. Coupling apparatus as recited in claim 15, wherein said first coupling element further comprises a plate which is removably connected to said second coupling element, said plate having an outer surface which constitutes said second engaging surface.

23. Coupling apparatus as recited in claim 22, wherein said plate is relatively softer than the other of said first and second engaging surfaces.

24. Coupling apparatus as recited in claim 15, wherein each of said second and fourth engaging surfaces is substantially flat.

25. Coupling apparatus as recited in claim 15, wherein said first locking element is a first protrusion which has a first bore, wherein said second locking element is a second protrusion, said second locking element is a second protrusion, and said connector is an elongated pin, said first protrusion having a first bore which has a longitudinal axis, said second protrusion having a second bore which has a longitudinal axis so that when said coupling apparatus is in said coupling mode, said second protrusion is adjacent said first protrusion and the longitudinal axis of said second bore is substantially axially aligned with the longitudinal axis of said first bore for enabling said elongated pin to be inserted into said first and second bores.

26. Coupling apparatus as recited in claim 15, wherein said first locking element is a first protrusion, said second locking element is a second protrusion, and said connector is an elongated pin, said first protrusion having a first bore which has a longitudinal axis, said second protrusion having a second bore which has a longitudinal axis so that when said tractor linkage is in said coupling mode with said tool, said second protrusion is adjacent said first protrusion and the longitudinal axis of said second bore is sufficiently vertically misaligned with the longitudinal axis of said first bore for enabling said elongated pin to be inserted into said first and second bores and to force said first and second bores into axial alignment.

27. Coupling apparatus as recited in claim 15, further comprising:

(a) a pair of spaced outwardly facing vertical stabilizing surfaces on one of said first and second coupling elements;

(b) a pair of spaced inwardly facing vertical surfaces on the other of said first and second coupling elements for engaging said outwardly facing vertical stabilizing surfaces when said coupling apparatus is in said coupling mode for providing lateral stability to the coupling of said tool and said linkage.

28. Coupling apparatus as recited in claim 27, wherein at least one of said tool and said linkage has vertical cam surfaces for guiding the vertical stabilizing surfaces of the other of said tool and said linkage into engagement with the vertical stabilizing surfaces of said one of said tool and said linkage when said linkage is moved from said uncoupling mode to said coupling mode.

* * * * *